US007738810B2

(12) United States Patent
Fujita

(10) Patent No.: US 7,738,810 B2
(45) Date of Patent: Jun. 15, 2010

(54) IMAGE FORMING APPARATUS AND METHOD OF COOLING CONTROL THEREOF

(75) Inventor: Hitomi Fujita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 653 days.

(21) Appl. No.: 11/676,117

(22) Filed: Feb. 16, 2007

(65) Prior Publication Data

US 2007/0196119 A1 Aug. 23, 2007

(30) Foreign Application Priority Data

Feb. 17, 2006 (JP) ..... 2006-040248

(51) Int. Cl.
*G03G 21/20* (2006.01)

(52) U.S. Cl. ..... 399/92

(58) Field of Classification Search ..... 399/68, 399/69, 92, 400, 54, 223, 228
See application file for complete search history.

(56) References Cited

U.S. PATENT DOCUMENTS 6,493,525 B2 * 12/2002 Nakamura et al. ..... 399/69
6,580,884 B2 * 6/2003 Kuwabara ..... 399/92
6,985,677 B2 * 1/2006 Yamagata et al. ..... 399/18

FOREIGN PATENT DOCUMENTS

| | | | |
|---|---|---|---|
| JP | 03-081783 | | 4/1991 |
| JP | 04134459 | A * | 5/1992 |
| JP | 07319370 | A * | 12/1995 |
| JP | 2000147962 | A * | 5/2000 |
| JP | 2002040873 | A * | 2/2002 |
| JP | 2002049282 | A * | 2/2002 |
| JP | 2004252045 | A * | 9/2004 |

* cited by examiner

*Primary Examiner*—Robert Beatty
(74) *Attorney, Agent, or Firm*—Hogan & Hartson LLP

(57) ABSTRACT

An electrophotographic image forming apparatus includes a fixer for heating a printing paper while feeding the same; a cooling device for cooling the fixer; a paper transport device for supplying the printing paper to the fixer; and a controller for receiving a print command including a specification of printing conditions and controlling the fixer, the cooling device, and the paper transport device, wherein the controller includes: a device that controls the fixer to change the velocity that the fixer feeds the printing paper during a printing job according to the printing conditions, and a device that controls the cooling device to change the cooling performance of the cooling device during the printing job according to the velocity of the fixer.

9 Claims, 6 Drawing Sheets

FIG. 4

| PROCESS | TEMPERATURE CONTROL | FIXING ROLLER | ROTATING SPEED OF FIXING ROLLER | STATE | COOLING FAN | | |
|---|---|---|---|---|---|---|---|
| STOP | STOP | STOP | — | STOP OPERATION OF FIXER | STOP | | |
| HR WARM UP | FB | ROTATION | NORMAL | TEMPERATURE OF HR AND PR IS INCREASED | LOW POWER COOLING (ROTATING AT LOW SPEED) | | |
| HR WARM UP | FB | ROTATION | NORMAL | TEMPERATURE OF PR IS INCREASED AFTER TEMPERATURE OF HR REACHES TARGET TEMPERATURE | LOW POWER COOLING (ROTATING AT LOW SPEED) | | |
| STANDBY | FB | STOP | — | MAINTAIN TEMPERATURE OF HR AND PR WHILE WAITING PRINT COMMAND | LOW POWER COOLING (ROTATING AT LOW SPEED) | | |
| PRE-FIXING | FB | ROTATION | NORMAL PAPER: NORMAL | FROM AFTER ACCEPTANCE OF PRINT COMMAND UNTIL IMMEDIATE BEFORE FEEDING OF PAPER INTO FIXING NIP | NORMAL | MONOCHROME: LOW | COLOR: HIGH |
| | | | THICK PAPER:1/2 | | 1/2 | LOW | |
| | | | OHP PAPER:1/4 | | 1/4 | | |
| IN-FIXING | FB | ROTATION | NORMAL PAPER: NORMAL | FROM IMMEDIATE BEFORE FEEDING OF PAPER INTO FIXING NIP UNTIL DISCHARGE OF PAPER | NORMAL | MONOCHROME: LOW | COLOR: HIGH |
| | | | THICK PAPER:1/2 | | 1/2 | LOW | |
| | | | OHP PAPER:1/4 | | 1/4 | | |
| POST-FIXING | FIXED | ROTATION | NORMAL PAPER: NORMAL | FROM DISCHARGING OF PAPER FROM FIXING NIP UNTIL DISCHARGE OF PAPER TO OUTSIDE OF MACHINE | NORMAL | MONOCHROME: LOW | COLOR: HIGH |
| | | | THICK PAPER:1/2 | | 1/2 | LOW | |
| | | | OHP PAPER:1/4 | | 1/4 | | |
| COOL DOWN | FB | STOP | — | WAIT UNTIL TEMPERATURE OF HR AND PR IS LOWERED | HIGH POWER COOLING (ROTATING AT HIGH SPEED) | | |

IMAGE FORMING APPARATUS AND METHOD OF COOLING CONTROL THEREOF

BACKGROUND

1. Technical Field

The present invention relates to an electrophotographic image forming apparatus and a method of cooling control thereof.

2. Related Art

An electrophotographic image forming apparatus includes a part which generates a large amount of heat such as a fixer, and a cooling device (typically, a cooling fan) for cooling the same. Japanese Unexamined Patent Application Publication No. 3-81783 (for example, from the 9th line in a lower right column in p. 5 to the 14th line in an upper left column in p. 6) discloses control of a cooling fan in the image forming apparatus and, in particular, a control method intended to reduce a noise of the cooling fan especially during stand-by. According to this method in the related art, the cooling fan is operated at a constant velocity at a high number of revolutions during an image forming operation, is operated at a constant velocity at a low number of revolutions immediately after the termination of the image forming operation while the temperature is high, and is operated intermittently at a low number of revolutions when the temperature during waiting is not high.

In view of reduction of power consumption due to driving of the cooling fan, the control method of the cooling fan according to the related art is not yet satisfactory.

SUMMARY

An advantage of some aspects of the invention is that an image forming apparatus is cooled effectively with a little power consumption.

An image forming apparatus according to an aspect of the invention includes: a fixer for heating a printing paper while feeding the same; a cooling device for cooling the fixer; a paper transport device for supplying the printing paper to the fixer; and a controller for receiving a print command including a specification of printing conditions and controlling the fixer, the cooling device, and the paper transport device. The controller includes a device that controls the fixer to change the velocity that the fixer feeds the printing paper during a printing job according to the printing conditions, and a device that controls the cooling device to change the cooling performance of the cooling device during the printing job according to the velocity of the fixer.

According to the electrophotographic image forming apparatus, the velocity that the fixer feeds the printing paper during the printing job changes depending on the printing conditions specified by the print command. For example, the velocity of the fixer is controlled to be the fastest for the normal paper, to be slower for the thick paper than for the normal paper, and to be the slowest for the OHP paper according to the type of the paper (normal paper, thick paper, OHP paper, and so on) as one of the printing conditions. This is because that the time required for increasing the temperature of the printing paper to an adequate fixing temperature differs depending on the type of the paper. In this manner, the cooling performance of the cooling device during the printing job changes according to the change of the velocity of the fixer to feed the printing paper according to the printing conditions. For example, the cooling device is controlled so as to provide a high cooling performance when the velocity of the fixer is high as in the case of printing the normal paper, and to provide a low cooling performance when the velocity of the fixer is low as in the case of printing the thick paper or the OHP paper. When the velocity of the fixer is low, the amount of heat per hour absorbed from the fixer by the printing paper is large. Therefore, the temperature of the fixer can hardly be increased. Therefore, by lowering the cooling performance at that time, the power consumption of the cooling device can be saved while securing the required cooling performance.

According to an electrophotographic image forming apparatus according to another aspect of the invention, the controller includes a device that controls the paper transport device so as to change an interval that the paper transport device supplies the printing paper to the fixer during the printing job according to the printing conditions, and a device for controlling the cooling device so as to change the cooling performance of the cooling device during the printing job according to the interval.

According to this electrophotographic image forming apparatus, the interval that the printing paper is supplied to the fixer during the printing job changes according to the printing conditions. For example, depending on the printing color that is one of the printing conditions, that is, whether it is the color printing or the monochrome printing, the interval of the paper supply is controlled to be long in the case of the color printing, and to be short in the case of the monochrome printing. This is because that the time required for forming a toner image and transferring the same is different between the color printing and the monochrome printing. In this manner, the cooling performance of the cooling device during the printing job changes according to the change of the interval of the paper supply to the fixer according to the printing conditions. For example, the cooling device is controlled so as to provide a high cooling performance when the interval is long as in the case of the color printing, and to provide a low cooling performance when the interval is short as in the case of the monochrome printing. Since the amount of heat per hour absorbed from the fixer by the printing paper is large when the interval is short, the temperature of the fixer can hardly be increased. By lowering the cooling performance at this time, the power consumption of the cooling device can be saved while securing the required cooling performance.

In an electrophotographic image forming apparatus according to another aspect of the invention, the controller includes a detection device that detects the temperature or the thermal state of the fixer, and a device that controls the cooling device so that the cooling performance of the cooling device during a printing job changes according to a state value detected by the detection device. Here, the state detected by the detection device includes the temperature of the fixer, the heating power of the fixer, and the length of time when the temperature of the fixer is higher than a predetermined threshold temperature, that is, the length of time weighted by the temperatures of the fixer at the respective time points.

According to the electrophotographic image forming apparatus, the temperature of the fixer or the thermal state is detected and the cooling performance of the cooling device is controlled according to the detected state. Therefore, when the fixer is in the state in which only a low cooling performance is required, the cooling performance of the cooling device is lowered correspondingly, so that the power consumption may be saved.

According to another aspect of the invention, a method of cooling control in the above-described electrophotographic image forming apparatus is also provided.

BRIEF DESCRIPTION OF THE DRAWINGS

The invention will be described with reference to the accompanying drawings, wherein like numbers reference like elements.

FIG. 4 is an explanatory drawing showing an intergradation of a control state of the fixer and the cooling fan according to the first embodiment of the invention.

DESCRIPTION OF EXEMPLARY EMBODIMENTS

Figure 1:
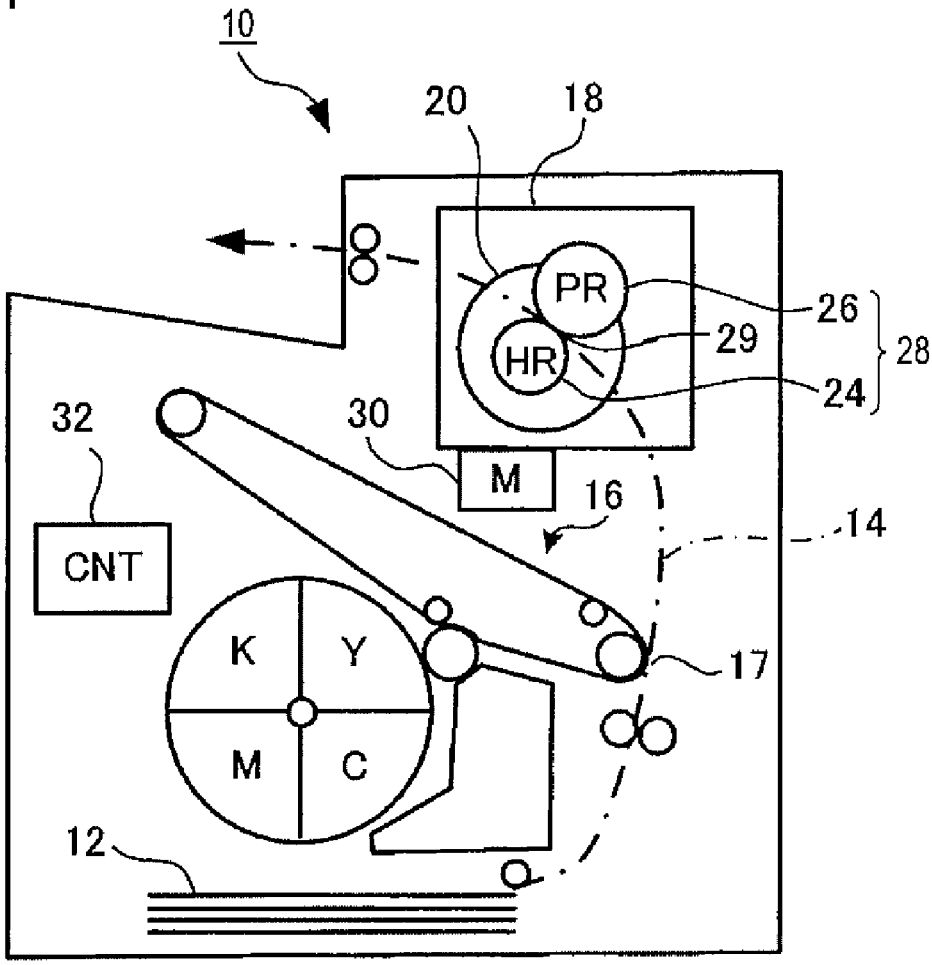
FIG. 1 shows a schematic configuration of an entire electrophotographic image forming apparatus according to a first embodiment of the invention.

FIG. 1 shows a schematic configuration of an entire electrophotographic image forming apparatus according to a first embodiment of the invention.

As shown in FIG. 1, an image forming apparatus 10 includes a paper transport device for transporting a printing paper 12 along a paper transport path 14 (entire configuration is not shown in the drawing), a toner image forming and transferring device 16 that generates a toner image and transfers the toner image to the printing paper 12 at a transfer position 17 on the paper transport path 14, and a fixer 18 arranged at a downstream position of the transfer position 17 along the paper transport path 14 for taking the printing paper 12 on which the toner image is transferred and fixing the toner image on the printing paper 12. In this embodiment, the toner image forming and transferring device 16 employs a secondary transfer system as a transfer system. However, this is illustrative only, and the invention is also applicable to an image processing apparatus employing other transfer systems.

The fixer 18 includes a heating roller 24 and a pressing roller 26, and in this specification, a set of the heating roller 24 and the pressing roller 26 is referred to as "fixing roller 28". The heating roller 24 and the pressing roller 26 are in abutment with each other so as to form a fixing nip 29 to which the printing paper 12 is nipped. The heating roller 24 comes into contact with a surface of the printing paper 12 on the side where the toner image is transferred at the fixing nip 29 and heats the same to a high temperature suitable for fixing. The pressing roller 26 presses the printing paper 12 from the opposite surface toward the heating roller 24 at the fixing nip 29 for bringing the surface of the printing paper 12 on the side on which the toner image is transferred to the heating roller 24. The fixer 18 is connected to a fixer drive motor 30, and the fixer drive motor 30 rotates and drives the fixing roller 28. As an example of a cooling device, a cooling fan 20 for cooling the fixing roller 28 is arranged in the vicinity of the fixer 18.

The image forming apparatus 10 further includes a controller 32. The controller 32 includes, for example, a computer and various peripheral circuits connected thereto and controls movements of various mechanisms in the image forming apparatus 10 described above. One of the control functions is a function for controlling the cooling fan 20 according to the principle of the invention.

Figure 2:
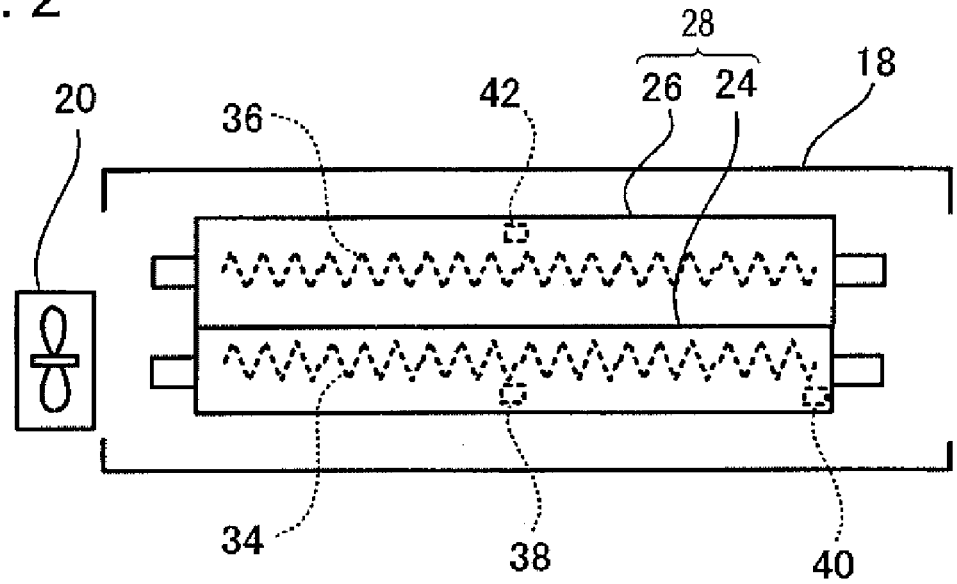
FIG. 2 shows a schematic configuration of the interior of a fixing roller and a positional relationship with respect to a cooling fan according to the first embodiment of the invention.

FIG. 2 shows a schematic configuration of the interior of the fixing roller 28 and a positional relationship with respect to the cooling fan 20.

As shown in FIG. 2, the heating roller 24 includes a heater 34 for heating the same (hereinafter referred to as HR heater) integrated therein. The pressing roller 26 also includes a heater (hereinafter, referred to as "PR heater") 36 integrated therein. The heating roller 24 includes temperature sensors (for example, thermistors) 38 and 40 at two positions, that is, at a center and an end in the longitudinal direction thereof for detecting the temperature thereof (hereinafter, the temperature sensor 38 at the center is referred to as "HR center temperature sensor, and the sensor 40 at the end is referred to as "HP end temperature sensor") integrated therein. The pressing roller 26 also includes a temperature sensor (for example, a thermistor) at a center in the longitudinal direction thereof (hereinafter, referred to as "PR center temperature sensor").

The cooling fan 20 is arranged in the vicinity of an axial end of the fixing roller 28. When the cooling fan 20 rotates, an air flow is generated in the fixer 18 in the direction substantially parallel to the axis of the fixing roller 28, and air in the fixer 18 heated by the fixing roller 28 is sucked by the cooling fan 20 and discharged out from the image forming apparatus 10.

Figure 3:
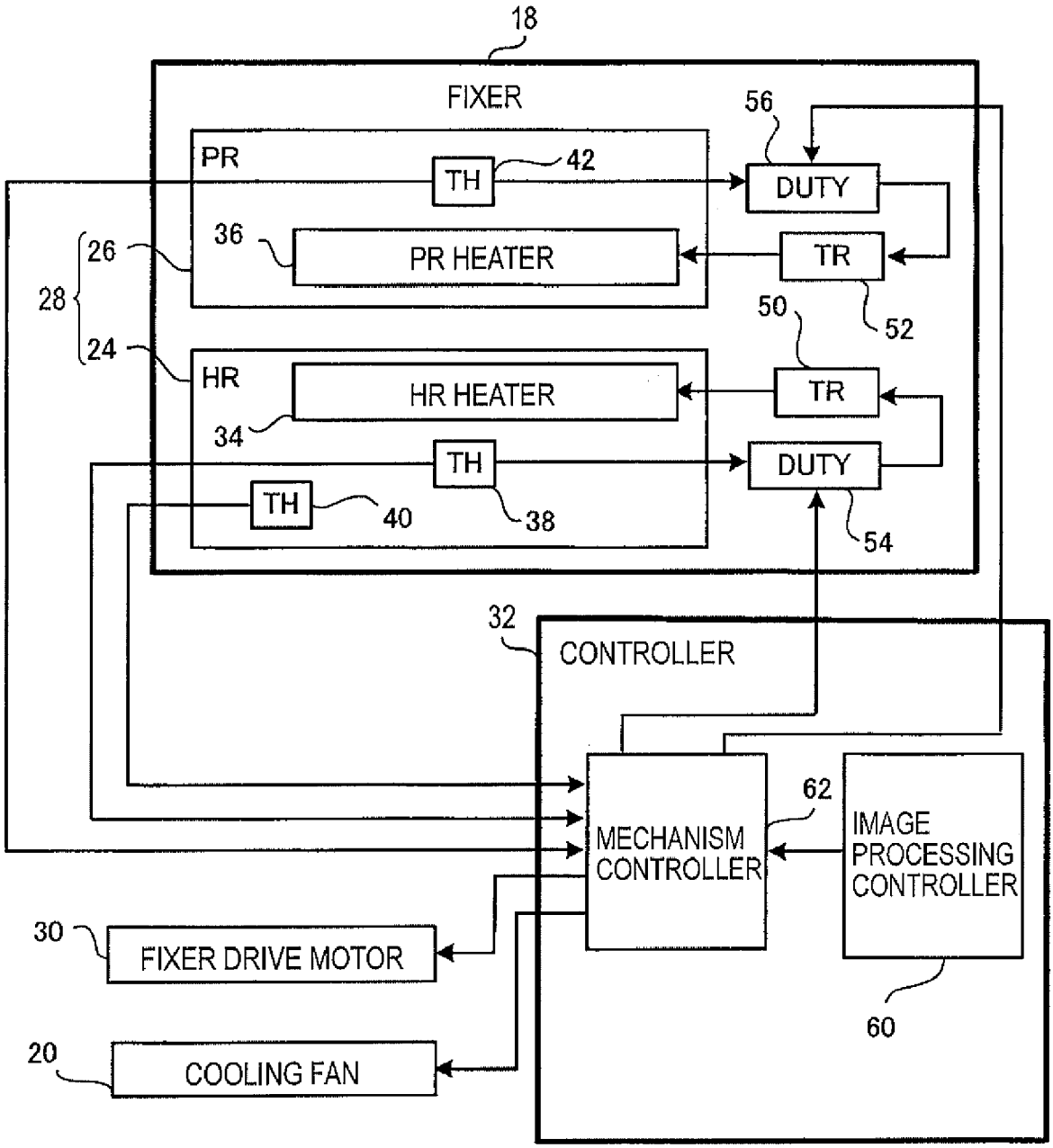
FIG. 3 shows an internal configuration and a function of a fixer and a controller according to the first embodiment of the invention.

FIG. 3 shows an internal configuration and a function of the fixer 18 and the controller 32.

As shown in FIG. 3, the fixer 18 includes a switching control device (for example, triode AC) 50 for controlling a current flowing to the HR heater 34 in the heating roller 24 (the amount of heat generated by the HR heater 34), a switching control device (for example, triode AC) 52 for controlling a current flowing to the PR heater 36 in the pressing roller 26 (the amount of heat generated by the PR heater 36), a duty control circuit 54 for controlling on duty (that is, a heating power) of the switching control device 50 for the HR heater 34 on the basis of an output of the HR center temperature sensor 38 in the heating roller 24, and a duty control circuit 56 for controlling on duty (that is, the heating power) of the switching control device 52 for the PR heater 36 on the basis of an output of a PR center temperature sensor 42 of the pressing roller 26. Although being omitted from the drawing, the HR heater 34, the PR heater 36, the switching control device 50 and the switching control device 52 configure a circuit (details are not shown in the drawing) which is able to connect the HR heater 34 and the PR heater 36 in series for causing both to generate heat simultaneously, or to cause the HR heater 34 and the PR heater 36 independently.

The controller 32 includes an image processing controller 60 and a mechanism controller 62. Both of the image processing controller 60 and the mechanism controller 62 may have a function to be realized by the computer of the controller 32 executing a program, may be specific hardware, or may be a combination thereof.

The image processing controller 60 generates an image data of an image to be printed, and outputs a print command for printing the image to the mechanism controller 62. The print command specifies various printing conditions, for example, printing colors such as color printing or monochrome printing, type of the printing paper 12 such as normal paper, thick paper or OHP paper, printing surfaces such as one side or both sides, or the size of the printing paper 12. The mechanism controller 62 receives a print command from the image processing controller 60 and controls movements of the various mechanisms such as the paper transport device, the toner image forming and transferring device 16, the fixer 18 and the cooling fan 20 in the image forming apparatus 10 described in conjunction with FIG. 1 in order to execute the printing operation requested by the print command.

From among various controlling operations for various mechanisms performed by the mechanism controller 62, FIG. 3 shows only the controlling operation relating control processing of the cooling fan 20. In other words, as shown in FIG. 3, the mechanism controller 62 controls the fixer drive motor 30 to control the rotation of the fixing roller 28. The mechanism controller 62 also controls the duty control circuit 54 in the fixer 18 to control the temperatures of the heating roller 24 and the pressing roller 26. The mechanism controller 62 controls the rotation of the cooling fan 20 in relation to the control of the fixer 18. In the control of the cooling fan 20, as described later, specification of the printing color and the specification of the type of the printing paper included in the print command from the image processing controller 60 are used.

FIG. 4 shows an intergradation of a control process (or a control state) of the fixer 18 and the cooling fan 20 performed by the mechanism controller 62.

A control process of the fixer 18 will be described first. As shown in FIG. 4, there are processes (states) of "STOP", "HR WARM UP", "PR WARM UP", "PRE-FIXING", "IN-FIXING", "POST-FIXING", and "COOL DOWN". When a power source of the image forming apparatus 10 is OFF, or in the power saved dormant state, the fixer 18 is in the stopped state. When the power source of the image forming apparatus 10 is turned ON, or when restored to the normal state from the power saved dormant state, the control of the fixer 18 by the mechanism controller 62 starts from the HR warm up process and proceeds to a standby process. When the print command is issued from the image processing controller 60 in the standby process, the pre-fixing process starts, and the processes from the pre-fixing process to the post-fixing process are performed for each printing paper 12 (or for each flow of a plurality of pieces of the printing paper 12 fed continuously without pause). Normally, as shown by an arrow of a solid line, the control returns to the standby process after the post-fixing process. However, when the temperature of the fixing roller 28 exceeds a predetermined maximum fixable temperature when the fixing roller starts rotating (when performing from the stopped state to the HR warm up process), or during a printing job (the pre-fixing process, the fixing process, and the post-fixing process), a cool down process is performed consecutively after the post-fixing process as shown by an arrow of a dot line, and then the control returns to the standby process. On the other hand, when the temperature of the fixing roller 28 underruns a predetermined minimum fixable temperature during the printing job, the HR warm up process is performed consecutively after the post-fixing process as shown by an arrow of a broken line.

In the HR warm up process, the fixing roller 28 is driven to rotate, and both of the HR heater 34 and the PR heater 36 are driven by a feedback (FB) control, so that the temperatures of both of the heating roller 24 and the pressing roller 26 is increased. When the temperature of the heating roller 24 reaches a predetermined target temperature for standby, the HR warm up process is ended, and the PR warm up process starts.

In the PR warm up process, the fixing roller 28 is driven to rotate, and the temperature of the heating roller 24 is maintained at a temperature near the target temperature for standby by the feedback control, while the temperature of the pressing roller 26 is further increased by the feedback control. When the temperature of the pressing roller 26 reaches a predetermined target temperature for standby, the PR warm up process is ended and a standby process starts.

In the standby process, the fixing roller 28 is stopped, and the temperatures of the heating roller 24 and the pressing roller 26 are maintained at temperatures near the respective target temperatures for standby by the feedback control while waiting for issue of the print command.

When the print command is issued, the pre-fixing process starts. The pre-fixing process is performed from the issue of the print command until immediately before (for example, 4 seconds before) the printing paper 12 enters the fixing nip 29. In the pre-fixing process, the fixing roller 28 is driven to rotate, and the temperatures of both of the heating roller 24 and the pressing roller 26 are increased to the respective target temperatures for fixing which are higher than the respective target temperatures for standby by the feedback control.

Subsequently, the fixing process is performed from immediately before (for example, 3 seconds before) the printing paper 12 enters the fixing nip 29 until it is passed completely through the fixing nip 29. In the fixing process, the fixing roller 28 is driven to rotate, and the temperatures of both of the heating roller 24 and the pressing roller 26 are maintained at the respective target temperatures for fixing by the feedback control.

Subsequently, the post-fixing process is performed during a period from a moment when the printing paper 12 is completely passed through the fixing nip 29 until it is discharged out from the image forming apparatus 10. In the post-fixing process, the fixing roller 28 is driven to rotate, and a current value flowing to the HR heater 34 and the PR heater 36 is fixed.

The number of revolutions (velocity of revolution) of the fixing roller 28 is controlled so as to be different depending on the type of the printing paper 12 (type of the paper specified through the print command) through the pre-fixing process, the fixing process and the post-fixing process. That is, when the type of the paper is a normal paper, the number of revolution of the fixing roller 28 is controlled to a predetermined normal (high) number of revolutions. In a case in which the type of the paper is a thick paper, the number of revolutions of the fixing roller 28 is controlled to be a predetermined mid-velocity (for example, a half a normal number of revolutions). The reason is that it is necessary to provide heat to the thick paper from the fixing roller 28 for a longer time than to the normal paper in order to increase the temperature of the thick paper to a temperature suitable for fixing. When the paper is the OHP paper, the number of revolutions of the fixing roller 28 is controlled to a predetermined low-velocity (for example, ¼ of the normal number of revolutions). The reason is that it is necessary to provide a larger amount of heat to the thick OHP paper from the fixing roller 28 for a longer time than to the thick paper in order to heat the OHP paper to a temperature suitable for fixing.

As described above, when the temperature of the fixing roller 28 exceeds the predetermined maximum fixable temperature when the fixing roller starts rotating (when the HR warm up process is performed from the stop state) or during the printing job (the pre-fixing process, the fixing process, and the post-fixing process), the cool down process is performed after the printing paper 12 is discharged out from the image forming apparatus 10. In the cool down process, the fixing roller 28 is stopped, and the heater temperatures of both of the heating roller 24 and the pressing roller 26 are lowered to temperatures near the respective target temperatures for standby by the feed back control.

The control of the fixer 18 preformed by the mechanism controller 62 has been described above. Although not shown, the mechanism controller 62 controls the paper transport device and the toner image forming and transferring device 16 described above as well. The control includes control of timing for transporting a plurality of pieces of the printing paper 12 in a case of printing on the plurality of pieces of the printing paper 12 relating control of the cooling fan 20 described later. That is, depending on whether the printing color specified by the print command is color printing or monochrome printing, the mechanism controller 62 differentiates the timing for feeding the printing paper 12 to the transfer position 17 (and by extension to the fixer 18), among others, the interval between the former printing paper 12 and the next printing paper 12. In this embodiment, since the secondary transfer system is employed as the transfer system, the mechanism controller 62 feeds the plurality of pieces of the printing paper 12 continuously with almost no interval or with short intervals continuously when performing the monochrome printing. However, when performing the color printing, the plurality of pieces of the printing paper 12 are fed intermittently at intervals (much longer than in the case of the monochrome printing) corresponding to a period required for forming toner images of a plurality of colors such as K, C, M and Y in sequence and performing the primary transfer.

In addition, the mechanism controller 62 controls the number of revolutions, that is, the cooling performance of the cooling fan 20 synchronously with the above-described control process of the fixer 18 as shown in FIG. 4. In other words, in a stop process in which the power source of the image forming apparatus 10 is in the OFF state, the cooling fan 20 is naturally stopped. When the power source of the image forming apparatus 10 is turned ON, the rotational drive of the cooling fan 20 is started. In this embodiment, a drive mode of the cooling fan 20 (hereinafter, referred to as "cooling model") includes a high cooling mode having a high cooling performance and a low cooling mode having a low cooling performance. In the high cooling mode, the cooling fan 20 is driven to rotate at a predetermined high number of revolutions, while in the low cooling mode, the cooling fan 20 is driven to rotate at a predetermined low number of revolutions (for example, a half the high number of revolutions). When the control of the fixer 18 is in any one of the HR warm up process, the PR warm up process and the standby process, the cooling fan 20 is driven in the low cooling mode.

On the other hand, when printing is performed, that is, when the control of the fixer 18 is any one of the pre-fixing process, the fixing process, and the post-fixing process, the cooling mode is controlled so as to be different depending on the number of revolutions of the fixing roller 28 (different depending on the type of the paper as described above) and the printing color specified by the print command. That is, when the number of revolutions of the fixing roller 28 is lower than the normal number of revolutions (in other words, when the type of the printing paper is the thick paper or the OHP paper), the cooling mode is controlled in the low cooling mode. The reason is in that a larger amount of heat is absorbed by the printing paper 12 from the fixing roller 28 during a unit time in comparison with the case of the printing on the normal paper at the normal number of revolutions in this case, the temperature of the fixing roller 28 can hardly be increased, so that the cooling performance of the cooling fan 20 may be low.

On the other hand, when the number of revolutions of the fixing roller 28 is the normal (high-velocity) number of revolutions (in other words, in a case in which the type of the paper is the normal paper), when the color printing is specified, the cooling mode is controlled in the low cooling mode, and when the monochrome printing is specified, the cooling mode is controlled in the high cooling mode. The reason why the cooling mode is differentiated between the color printing and the monochrome printing is as follows. That is, as described above, when performing the monochrome printing, the plurality of pieces of the printing paper 12 is supplied to the fixing roller 28 continuously with almost no interval or with short intervals In contrast, when performing the color printing, the plurality of pieces of the printing paper 12 are fed to the fixing roller 28 intermittently at intervals much longer than in the case of the monochrome printing. Therefore, since the amount of heat absorbed from the fixing roller 28 to the printing paper 12 during the monochrome printing is larger than in the case of the color printing, the temperature of the fixing roller 28 can hardly be increased, so that the cooling performance of the cooling fan 20 may be low.

In the cool down process performed when the fixing roller 28 is in the overheated state, the cooling mode is controlled in the high cooling mode in order to cool the fixing roller 28 efficiently.

Figure 5:
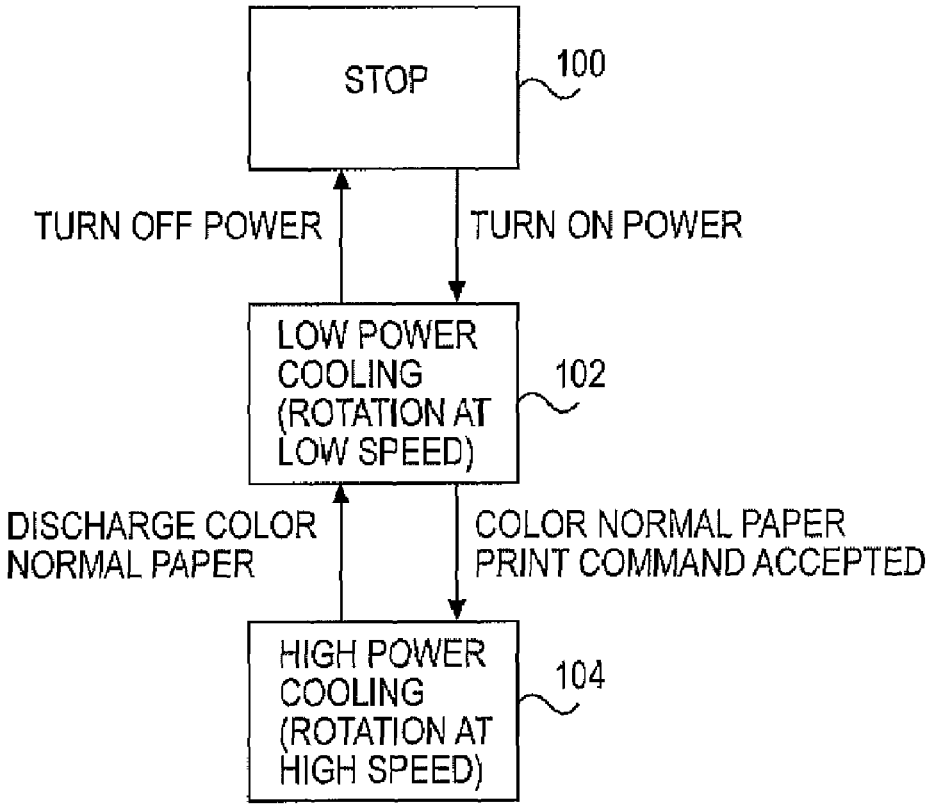
FIG. 5 is an explanatory drawing showing control for making a cooling mode intergrade according to the first embodiment of the invention.

FIG. 5 shows control for making the cooling mode performed by the mechanism controller 62 intergrade as described above.

As shown in FIG. 5, when the power source of the image forming apparatus 10 is in the OFF state, the cooling fan 20 is stopped (Block 100). When the power source of the image forming apparatus 10 is turned ON, the cooling fan 20 is operated first in a low cooling mode 102, and rotates at a predetermined low number of revolutions. Then, the print command for ordering the color printing to the normal paper is issued to the mechanism controller 62, the cooling mode is switched from the low cooling mode 102 to a high cooling mode 104, so that the cooling fan 20 rotates at a predetermined normal (high-velocity) number of revolutions. Then, when the normal paper after color printing is discharged, the cooling mode returns to the low cooling mode 102 again, and the cooling fan 20 is lowered to the predetermined low number of revolutions. Then, only when the print command for ordering the color printing on the normal paper is issued, the high cooling mode 104 is selected Even when the print command for ordering the printing other than the color printing to the normal paper is issued, the cooling mode is maintained in the low cooling mode 102.

As described above, in the period before printing job when the temperature of the fixing roller 28 is still low (the HR warm up process, the PH warm up process, and the standby process), the cooling fan 20 is controlled to a low number of revolutions. During the printing job, even when the number of revolutions of the fixing roller 20 is relatively low or the fixing temperature is high according to the type of the paper, relatively large amount of heat is absorbed from the fixing roller 28 by the printing paper 12 and hence the temperature of the fixing roller 28 can hardly be increased as in the case in which the printing paper 12 is supplied relatively frequently to the fixing roller 28, the number of revolution of the cooling fan 20 is controlled at the low number of revolutions. In such a control, the power consumption of the cooling fan 20 is saved while a required cooling performance is secured.

Subsequently, an electrophotographic image forming apparatus according to a second embodiment of the invention will be described. The general configuration of the image forming apparatus according to the second embodiment is basically the same as the configuration shown in FIG. 1.

Figure 6:
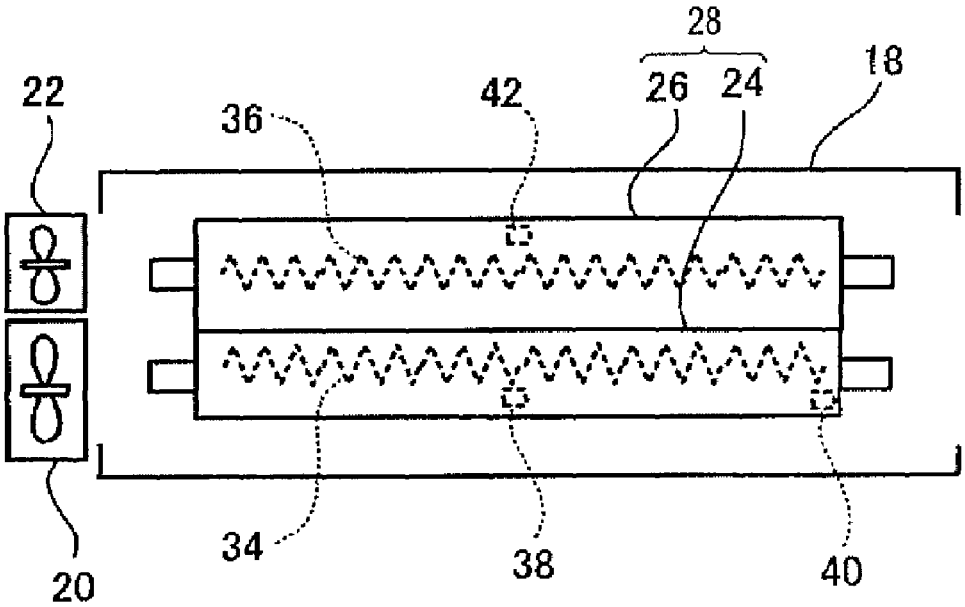
FIG. 6 shows the fixer and two cooling fans provided in an electrophotographic image forming apparatus according to a second embodiment of the invention.

FIG. 6 shows the fixer 18 and two cooling fans 20 and 22 provided in the electrophotographic image forming apparatus according to the second embodiment of the invention.

As shown in FIG. 6, the configuration of the fixer 18 itself is the same as the first embodiment described already by reference to FIG. 2. However, there is an additional cooling fan (hereinafter referred to as "second cooling fan") 22 is provided in the vicinity of the fixer 18 in addition to the cooling fan (hereinafter referred to as "first cooling fan") 20 as in the first embodiment. The second cooling fan 22 is low in maximum cooling performance and in maximum power consumption in comparison with the first cooling fan 20. The second cooling fan 22 may be adapted to suck air from the interior of the fixer 18 and discharge the air out from the image forming apparatus as in the case of the first cooling fan 20 or, in contrast, may be adapted to suck air from the outside of the image forming apparatus and blow into the fixer 18. The second cooling fan 22 may be arranged so as to cool the heating roller 24 more than the pressing roller 26 as the first cooling fan 20, or, on the contrary, may be arranged so as to cool the pressing roller 26 more than the heating roller 24. The second cooling fan 22 may be arranged on the same side as the first cooling fan 20 or on the opposite side with respect to the fixing roller 28 as shown in FIG. 6.

Figure 7:
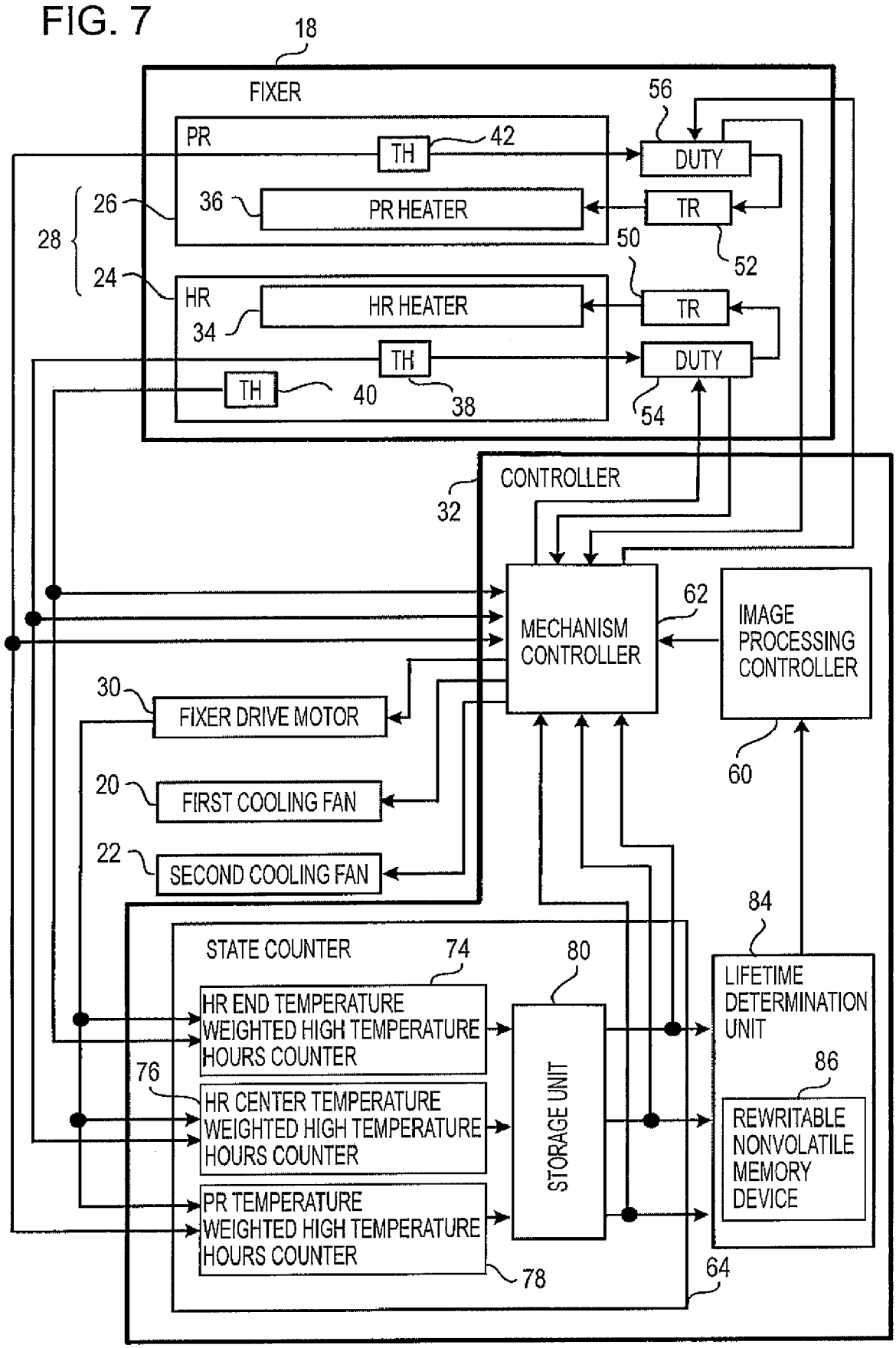
FIG. 7 shows an internal configuration and a function of the fixer and the controller according to the second embodiment.

FIG. 7 shows a configuration of the fixer 18 in the image forming apparatus and a functional configuration of the controller 32 according to the second embodiment.

The controller 32 includes the image processing controller 60, the mechanism controller 62, a state counter 64, and a lifetime determination unit 84. Any of the image processing controller 60, the mechanism controller 62, the state counter 64 and the lifetime determination unit may have a function to be realized by the computer of the controller 32 executing a program by, may be specific hardware, or may be a combination thereof.

The image processing controller 60 has the same function as that in the first embodiment already described above. On the other hand, the mechanism controller 62 has a control function relating control of the first and second cooling fans 20 and 22 different from those in the first embodiment. However, other control functions are the same as those in the first embodiment. FIG. 7 selectively shows a configuration of the control functions of the mechanism controller 62 relating the first and second cooling fans 20 and 22. As shown in the drawing, the mechanism controller 62 inputs the temperature at the center and the end of the heating roller 24 (hereinafter referred to as "HR center temperature" and "HR end temperature") from the temperature sensors 38, 40 and 42 in the fixer 18, and the temperature at the center of the pressing roller 26 (hereinafter, referred to as "PR temperature"). Then, the mechanism controller 62 inputs a signal for controlling on duty, that is, a heating power (hereinafter, referred to as "HR heating power") of the HR heater 34 and a signal for controlling the on duty of the PR heater 36 (hereinafter, referred to as "PR heating power") from the duty control circuits 54 and 56 in the fixer 18. Furthermore, the mechanism controller 62 also inputs a plurality of types of counted index values (values representing a thermal state of the fixing roller 28, and will be described from the state counter 64. The mechanism controller 62 controls the number of revolutions (cooling performance) of the first and second cooling fans 20, 22 on the basis of these input signals as will be described later.

The state counter 64 counts various types of predetermined index values representing the thermal state of the fixer 18 (fixing roller 28) respectively, and includes an HR end temperature weighted high temperature hours counter 74, an HR center temperature weighted high temperature hours counter 76, and a PR temperature weighted high temperature hours counter 78. The state counter 64 includes a storage unit 80, and the storage unit 80 is used for storing counted values of the HR end temperature weighted high temperature hours counter 74, the HR center temperature weighted high temperature hours counter 76, and the PR temperature weighted high temperature hours counter 78 temporarily. The counted values of the HR end temperature weighted high temperature hours counter 74, the HR center temperature weighted high temperature hours counter 76, and the PR temperature weighted high temperature hours counter 78 stored in the storage unit 80 are fed to the lifetime determination unit 84.

The lifetime determination unit 84 includes a rewritable nonvolatile memory device (for example, FRAM) 86, receives the plurality of types of index values described above counted by the state counter 64, sums up the respective index values received from the beginning of usage for the initial time of the fixer 18 to the present, and stores the sum of the respective index values in the memory device 86. Then, the lifetime determination unit 84 has preset determination threshold values for the respective plurality of types of index values, compares the current sums of the respective index values in the memory device 86 with the respective determination threshold values, and determines whether the fixer 18 reaches the end of the lifetime or not on the basis of the result of comparison. For example, when the sum of any index values exceeds the determination threshold value, it is determined that the fixer 18 reaches the end of its lifetime. Although the result of determination by the lifetime determination unit 84, especially the result of determination that the fixer 18 reaches the end of the lifetime is not shown in FIG. 7, it is informed to a user through a user interface of the image forming apparatus 10 or via an external device such as a host device communicably connected to the image forming apparatus 10, or is informed to the image processing controller 60 as one of error occurrence information for being used for print control such as to stop the printing operation.

The functions of the HR end temperature weighted high temperature hours counter 74, the HR center temperature weighted high temperature hours counter 76, and PR temperature weighted high temperature hours counter 78 in the state counter 64 are as follows.

The HR end temperature weighted high temperature hours counter 74 counts the length of time where the fixer drive motor 30 is being driven while the HR end temperature detected by the HR end temperature sensor 40 is a high temperature reaches or exceeds the preset HR end temperature threshold value (that is, the length of time where the fixing roller 28 rotates). However, the HR end temperature weighted high temperature hours counter 74 does not perform a simple time counting operation such as to count the value of the length of cycle time in certain count cycles, but perform a temperature weighted counting operation such as to weight the length of count cycle time according to the height of the HR end temperature at that time in the certain count cycles, and count the value of the length of the weighted time. That is, the HR end temperature weighted high temperature hours counter 74 obtains an excess of temperature which corresponds to the temperature currently exceeding the HR end temperature threshold value of the HR end temperature (difference between the HR end temperature and the HR end temperature threshold value) every time when the certain count cycles (for example, 10 msec) has elapsed and when the HR end temperature reaches or exceeds the HR end temperature threshold value and the fixer drive motor 30 is being driven, multiplies the value of the excess of temperature by the value of the length of time of the count cycle, and counts the counted value corresponding to the multiplied value. At this time, the HR end temperature weighted high temperature hours counter 74 repeats an operation to store the counted value in the storage unit 80 temporarily and add the calculated multiplied value to the counted value stored in the storage unit 80 in the aforementioned count cycle to realize the above-described temperature weighted counting operation. The index value obtained by counting in this manner is referred to as "HR end temperature weighted high temperature hours", hereinafter. The counted value of the HR end temperature weighted high temperature hours stored in the storage unit 80 is provided to the mechanism controller 62 and the lifetime determination unit 84.

The HR center temperature weighted high temperature hours counter 76 performs the temperature weighted counting operation for the HR center temperature detected by the HR center temperature sensor 38 such as to count the length of time weighted according to the height of the HR center temperature in the respective count cycles in the same manner as the HR end temperature weighted high temperature hours counter 74 described above. That is, the HR center temperature weighted high temperature hours counter 76 obtains an excess of temperature which corresponds to the temperature currently exceeding the HR center temperature threshold value of the HR center temperature (difference between the HR center temperature and the HR center temperature threshold value) every time when the certain count cycles (for example, 10 msec) has elapsed and when the HR center temperature reaches or exceeds the preset HR center temperature threshold value and the fixer drive motor 30 is being driven, multiplies the excess of temperature by the value of the length of time of the count cycle, and counts the counted value corresponding to the multiplied value. At this time, the HR center temperature weighted high temperature hours counter 76 repeats an operation to store the counted value in the storage unit 80 temporarily and add the calculated multiplied value to the counted value stored in the storage unit 80 in the aforementioned count cycle to realize the above-described temperature weighted counting operation. The index value obtained by counting in this manner is referred to as "HR center temperature weighted high temperature hours", hereinafter. The counted value of the HR center temperature weighted high temperature hours stored in the storage unit 80 is provided to the mechanism controller 62 and the lifetime determination unit 84.

The PR temperature weighted high temperature hours counter 78 performs the temperature weighted counting operation for the PR temperature detected by the PR center temperature sensor 42 such as to count the length of time weighted according to the height of the PR temperature in the respective count cycles in the same manner as the HR end temperature weighted high temperature hour counter 74 and the HR center temperature weighted high temperature hours counter 76 described above. That is, the PR temperature weighted high temperature hours counter 78 obtains an excess of temperature which corresponds to the temperature currently exceeding the PR temperature threshold value of the PR temperature (difference between the PR temperature and the PR temperature threshold value) every time when the certain count cycles (for example, 10 msec) has elapsed and when the PR temperature reaches or exceeds the preset PR temperature threshold value and while the fixer drive motor 30 is being driven, multiplies the excess of temperature by the value of the length of time of the count cycle, and counts the counted value corresponding to the multiplied value. At this time, the PR temperature weighted high temperature hours counter 78 repeats an operation to store the counted value in the storage unit 80 temporarily and add the calculated multiplied value to the counted value stored in the storage unit 80 in the aforementioned count cycle to realize the above-described temperature weighted counting operation. The index value obtained by counting in this manner is referred to as "PR temperature weighted high temperature hours", hereinafter. The counted value of the PR temperature weighted high temperature hours stored in the storage unit 80 is provided to the mechanism controller 62 and the lifetime determination unit 84.

The meanings of the HR end temperature weighted high temperature hours, the HR center temperature weighted high temperature hours, and the PR temperature weighted high temperature hours will be described in detail on the basis of FIG. 8.

Figure 8:
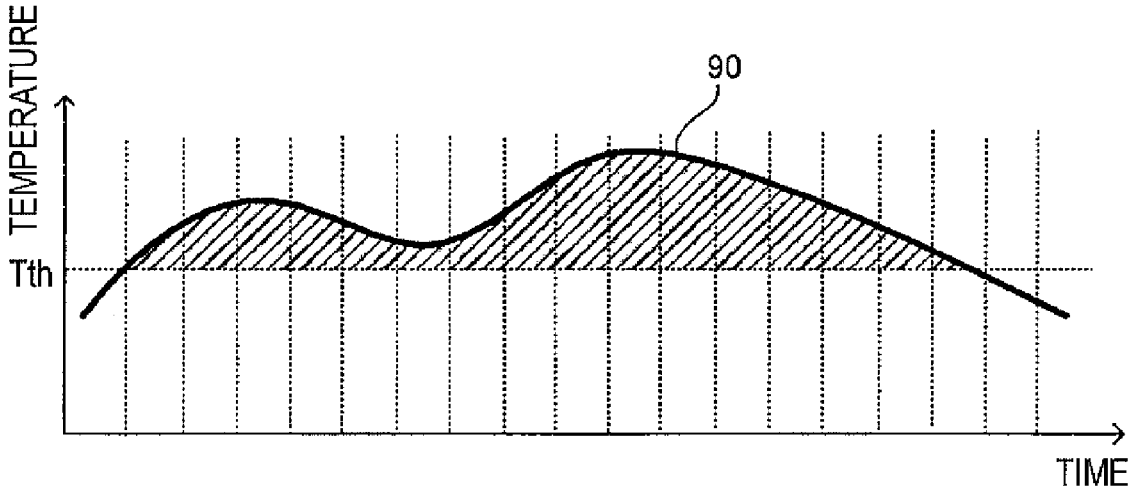
FIG. 8 is an explanatory drawing showing the meaning of temperature weighted high temperature hours in the second embodiment.

For example, in FIG. 8, it is assumed that a temperature change curve 90 is a change curve of the HR end temperature, and the temperature Tth is the HR end temperature threshold value. Then, the surface area of an area indicated by oblique hatching (that is, a value obtained by integrating the excess of temperature exceeding the HR end temperature threshold value of the HR end temperature by time) substantially corresponds to the HR end temperature weighted high temperature hours. When it is assumed that the temperature change curve 90 is a change curve of the HR center temperature, and the temperature Tth is the HR center temperature threshold value, the surface area of the area indicated by the oblique hatching substantially corresponds to the HR center temperature weighted high temperature hours. When it is assumed that the temperature change curve 90 is a change curve of the PR temperature, and the temperature Tth is the PR temperature threshold value, the surface area of the area indicated by the oblique hatching substantially corresponds to the PR temperature weighted high temperature hours.

Therefore, the HR end temperature weighted high temperature hours, the HR center temperature weighted high temperature hours, and the PR temperature weighted high temperature hours are index values added with both of the length of time and the extent of high temperature when the HR end temperature, the HR center temperature and the PR temperature are higher than the temperature threshold values thereof, respectively. In other words, these weighted high temperature hours reflect the extent of the margins of the amounts of heat accumulated in the heating roller 24 and the pressing roller 26 until then when the heating roller 24 and the pressing roller 26 are in the high temperature state. The above described HR end temperature threshold value, the HR center temperature threshold value and the PR temperature threshold value may be different values and may be the same values.

Subsequently, the controlling operation of the first and second cooling fans 20 and 22 performed by the mechanism controller 62 in the image forming apparatus according to the second embodiment will be described.

Figure 9:
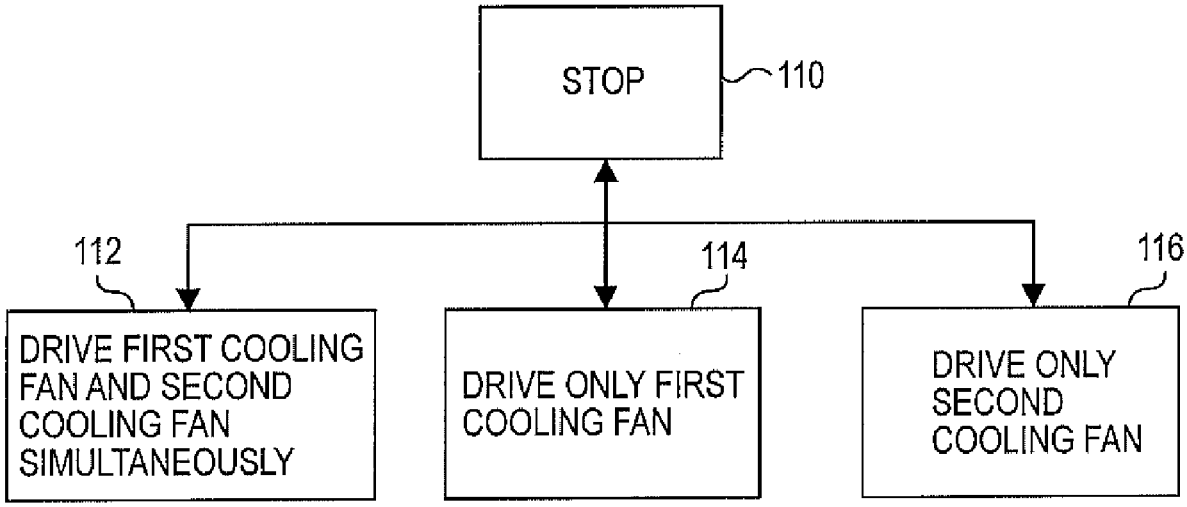
FIG. 9 is an explanatory drawing showing an intergradation of drive modes of first and second cooling fans controlled by a mechanism controller 62 according to the second embodiment.

FIG. 9 shows intergradations of the drive modes of the first and second cooling fans 20 and 22 controlled by the mechanism controller 62.

As shown in FIG. 9, the drive modes of the first and second cooling fans 20 and 22 include a stop mode 110, a simultaneous drive mode 112, a first fan mode 114, and a second fan mode 116. In the stop mode 110, both of the first and second cooling fans 20 and 22 are stopped. In the simultaneous drive mode 112, both of the first and second cooling fans 20 and 22 rotate. In the first fan mode 114, only the first cooling fan 20 rotates independently. In the second fan mode 116, only the second cooling fan 20 rotates independently. The respective numbers of revolutions of the first and second cooling fans 20 and 22 in the simultaneous drive mode 112, the first fan mode 114 and the second fun mode 116 may be preset fixed numbers of revolutions, or may be variably controlled according to the respective signals fed to the mechanism controller 62 as described above. The cooling performances demonstrated by these three drive modes 112, 113 and 116 are such that the greatest cooling performance is demonstrated in the simultaneous drive mode 112, the second greatest cooling performance is demonstrated in the first fan mode 114, and the third greatest cooling performance is demonstrated in the second fan mode 116. In contrast, regarding the effect of saving of the power consumption is the greatest in the second fan mode 116, the second highest in the first fan mode 114, and the third highest in the simultaneous drive mode 112.

The mechanism controller 62 comprehends various state values (that is, the HR center temperature, the HR end temperature, the PR temperature, the HR heating power, the PR heating power control, the HR end temperature weighted high temperature hours, the HR center temperature weighted high temperature hours, and the PR temperature weighted high temperature hours) from the various input signals described already on the basis of FIG. 7 at regular intervals before the printing job and during the printing job while controlling the control process of the fixer 18 described already on the basis of FIG. 4, and selects any one of the drive modes 110, 112, 114 and 116 shown in FIG. 9 on the basis of these state values, and controls the number of revolutions of the first and second cooling fans 20 and 22.

An example of the control will be shown below. That is, the mechanism controller 62 has a preset first mode switching threshold value, a second mode switching threshold value which is lower than the first mode switching threshold value, and a third mode switching threshold value which is further lower than the second mode switching threshold value for the respective state values described above. When the power source of the image forming apparatus is ON, the mechanism controller 62 comprehends the various state values periodically, and compares the respective state values and the first, second, and third mode switching threshold values corresponding to the respective state values. When any of the state values exceeds the first mode switching threshold value corresponding thereto as a consequence, the mechanism controller 62 selects the simultaneous drive mode 112 and drives both of the first and second cooling fans 20 and 22 to rotate. When no state value exceeds the first mode switching threshold value corresponding thereto, but any one of the state values exceeds the second mode switching threshold value corresponding thereto as a consequence of the comparison, the mechanism controller 62 selects the first fan mode 114 and drives only the first cooling fan 20 to rotate. When no state value exceeds the second mode switching threshold value corresponding thereto, but any one of the state values exceeds the third mode switching threshold value corresponding thereto as a consequence of the comparison, the mechanism controller 62 selects the second fan mode 116, and drives only the second cooling fan 22 to rotate. When no state value exceeds the third mode switching threshold value corresponding thereto as a consequence of the comparison, the mechanism controller 62 selects the stop mode 110 and stops both of the first and second cooling fans 20 and 22.

In this manner, by detecting the actual state of the temperature or the heat of the fixer 18 and switching the driving state of the cooling fans in a plurality of levels on the basis of the detected state, the power consumption of cooling may be saved while maintaining a required cooling performance. In particular, by controlling using the state values added with both of the temperature of the cooling object and the duration of the corresponding temperature such as the HR end temperature weighted high temperature hours, the HR center temperature weighted high temperature hours, and the PR temperature weighted high temperature hours, that is, the state values in which the amount of heat accumulated in the cooling object thus far, the required cooling performance may be determined further adequately. In addition, by using these state values not only in control of the cooling fans 20 and 22, but also in determination whether the fixer 18 reaches the end of the lifetime, the accuracy of determination of the lifetime is improved.

Although the embodiments of the invention have been described thus far, this embodiment is illustrative only, and the invention is not limited to these embodiments. The invention may be implemented in various modes without departing the scope of the invention.

For example, in the second embodiment described above, a number of the state values described above are used as the basic information of control. However, only part of these state values may be utilized In the second embodiment, the combination of the two cooling fans is changed for changing the cooling performance. However, the number of revolutions of the one single cooling fan may be changed as in the first embodiment instead, or in addition thereto. Also, the control performed on the basis of the printing color and the type of the paper as in the first embodiment and the control performed on the basis of the detected state values as in the second embodiment may be combined.

In the second embodiment, the method of multiplying the excess of temperature with respect to the set temperature threshold value of the detected temperature by time is employed as the method of weighting the temperature when counting the HR end temperature weighted high temperature hours, the HR center temperature weighted high temperature hours, and the PR temperature weighted high temperature hours. However, other methods such as a method of calculating the weighting coefficient from the excess of temperature with respect to the detected temperature itself or the preset threshold value by a predetermined function and multiplying the weighting coefficient by time may also be employed.

What is claimed is:

1. An electrophotographic image forming apparatus comprising:

a fixer for heating a printing paper while feeding the same;

a cooling device for cooling the fixer;

a paper transport device for supplying the printing paper to the fixer; and a controller for receiving a print command including a specification of printing conditions and controlling the fixer, the cooling device, and the paper transport device, wherein the controller includes:

a device that controls the fixer to change the velocity that the fixer feeds the printing paper during a printing job according to the printing conditions, and a device that controls the cooling device to change the cooling performance of the cooling device during the printing job according to the velocity of the fixer, wherein a first cooling performance is provided only when the print command for printing color on a normal paper is received, and a second cooling performance is provided when the print command is other than for printing color on a normal paper.

2. The electrophotographic image forming apparatus according to claim 1, wherein the controller includes:

a device that controls the paper transport device so as to change an interval that the paper transport device supplies a plurality of pieces of the printing paper during the printing job according to the printing conditions, and a device that controls the cooling device so as to change the cooling performance of the cooling device during the printing job according to the interval.

3. The electrophotographic image forming apparatus according to claim 1, wherein the first cooling performance is a high cooling performance and the second cooling performance is a low cooling performance.

4. An electrophotographic image forming apparatus comprising:

a fixer for heating a printing paper while feeding the same;

a cooling device for cooling the fixer;

a paper transport device for supplying the printing paper to the fixer; and a controller for receiving a print command including a specification of printing conditions and controlling the fixer, the cooling device, and the paper transport device, wherein the controller includes a device that controls the paper transport device so as to change an interval that the paper transport device supplies the printing paper to the fixer during a printing job according to the printing conditions, and a device that controls the cooling device so as to change the cooling performance of the cooling device during the printing job according to the interval, wherein a first cooling performance is provided only when the print command for printing color on a normal paper is received, and a second cooling performance is provided when the print command is other than for printing color on a normal paper.

5. The electrophotographic image forming apparatus according to claim 4, wherein the first cooling performance is a high cooling performance and the second cooling performance is a low cooling performance.

6. A method of cooling control in an electrophotographic image forming apparatus including a fixer, and a cooling device for cooling the fixer, comprising:

cooling the fixer by the cooling device;

receiving a print command including a specification of printing conditions;

controlling the fixer so as to change the velocity that the fixer feeds the printing paper during a printing job according to the printing conditions; and controlling the cooling device so as to change the cooling performance of the cooling device during the printing job according to the velocity of the fixer, wherein a first cooling performance is provided only when the print command for printing color on a normal paper is received, and a second cooling performance is provided when the print command is other than for printing color on a normal paper.

7. The method of cooling control in the electrophotographic image forming apparatus according to claim 6, wherein the first cooling performance is a high cooling performance and the second cooling performance is a low cooling performance.

8. A method of cooling control in an electrophotographic image forming apparatus having a paper transport device, a fixer, and a cooling device for cooling the fixer; comprising:

cooling the fixer by the cooling device;

receiving a print command including a specification of printing conditions;

controlling the paper transport device so as to change an interval that the paper transport device feeds a printing paper to the fixer during a printing job according to the printing conditions; and cooling the cooling device so as to change the cooling performance of the cooling device during the printing job according to the interval, wherein a first cooling performance is provided only when the print command for printing color on a normal paper is received, and a second cooling performance is provided when the print command is other than for printing color on a normal paper.

9. The method of cooling control in the electrophotographic image forming apparatus according to claim 8, wherein the first cooling performance is a high cooling performance and the second cooling performance is a low cooling performance.

* * * * *